US011814694B2

(12) United States Patent
Schlenkert et al.

(10) Patent No.: US 11,814,694 B2
(45) Date of Patent: Nov. 14, 2023

(54) METHOD FOR PRODUCING A HIGHLY HEAT-RESISTANT WEAPON BARREL PROVIDED WITH A TWIST PROFILE

(71) Applicant: Rheinmetall Waffe Munition GmbH, Unterluess (DE)

(72) Inventors: Gert Schlenkert, Duesseldorf (DE); Ulrich Keller, Unterluess (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 76 days.

(21) Appl. No.: 17/208,614

(22) Filed: Mar. 22, 2021

(65) Prior Publication Data

US 2021/0207233 A1 Jul. 8, 2021

Related U.S. Application Data

(63) Continuation of application No. PCT/EP2019/072857, filed on Aug. 27, 2019.

(30) Foreign Application Priority Data

Sep. 21, 2018 (DE) ..... 10 2018 123 278.0

(51) Int. Cl.

| | |
|---|---|
| ***C01D 9/12*** | (2006.01) |
| ***B21C 37/00*** | (2006.01) |
| ***C21D 1/18*** | (2006.01) |
| ***C21D 6/00*** | (2006.01) |
| ***C22C 38/22*** | (2006.01) |
| ***C21D 9/12*** | (2006.01) |
| ***B21C 37/15*** | (2006.01) |
| ***C22C 38/24*** | (2006.01) |

(52) U.S. Cl.

CPC ..... *C21D 9/12* (2013.01); *B21C 37/153* (2013.01); *C21D 1/18* (2013.01); *C21D 6/00* (2013.01); *C22C 38/22* (2013.01); *C22C 38/24* (2013.01); *C21D 2261/00* (2013.01)

(58) Field of Classification Search

CPC ... C21D 9/12; C21D 1/18; C21D 6/00; C21D 2261/00; C21D 1/25; C21D 1/74; C21D 9/10; B21C 37/153; B21C 37/152; B21C 37/207; C22C 38/22; C22C 38/24; C25D 3/04; F41A 21/18

See application file for complete search history.

(56) References Cited

U.S. PATENT DOCUMENTS

| | | | | |
|---|---|---|---|---|
| 8,372,219 | B2 | 2/2013 | Caliskanoglu et al. | |
| 8,910,409 | B1 | 12/2014 | Fonte | |
| 2004/0140292 | A1* | 7/2004 | Kelley | B23K 9/048 219/76.13 |
| 2010/0003162 | A1 | 1/2010 | Arrenbrecht et al. | |
| 2011/0253270 | A1* | 10/2011 | Caliskanoglu | C22C 38/24 148/579 |
| 2018/0051967 | A1* | 2/2018 | Schwark | F42B 10/26 |

FOREIGN PATENT DOCUMENTS

| | | | |
|---|---|---|---|
| DE | 1927822 | A1 | 3/1972 |
| DE | 19544824 | A1 | 2/1997 |
| DE | 102006025241 | A1 | 12/2007 |
| DE | 102016111571 | A1 | 12/2017 |
| EP | 2375212 | A2 | 10/2011 |

OTHER PUBLICATIONS

International Search Report dated Nov. 27, 2019 in corresponding application PCT/EP2019/072857.

Waffentechnisches Taschenbuch, 9 edition 1995, pp. 299-300, Rheinmetall.

https://www.merkel-die-jagd.de/de/unternehmen/lauffertigung/ , accessed from the internet Jul. 29, 2019, Merkel Jagd- und Sportwaffen GmbH.

German Office Action dated Jul. 29, 2019 in corresponding application 10 2018 123 278.0.

* cited by examiner

*Primary Examiner* — Anthony M Liang
*Assistant Examiner* — Danny N Kang
(74) *Attorney, Agent, or Firm* — Muncy, Geissler, Olds & Lowe, P.C.

(57) ABSTRACT

In order to provide an economical method for producing a weapon barrel, in which a considerable plasticisation of the barrel inner wall and thus of the twist profile is avoided when armour-piercing ammunition is shot, in particular in the case of an intense firing sequence, it is proposed not to introduce the twist profile of the weapon barrel into a barrel blank, the material of which has its end strength already as a result of hardening and tempering, but has a lower strength level (approximately 800-1000 MPa). Only once the twist profile has been formed by extrusion or hammering is the steel hardened and tempered to a predefined strength value >1000 MPa, and is the barrel blank that is provided with the twist profile mechanically processed further.

6 Claims, No Drawings

METHOD FOR PRODUCING A HIGHLY HEAT-RESISTANT WEAPON BARREL PROVIDED WITH A TWIST PROFILE

This nonprovisional application is a continuation of International Application No. PCT/EP2019/072857, which was filed on Aug. 27, 2019 and which claims priority to German Patent Application No. 10 2018 123 278.0, which was filed in Germany on Sep. 21, 2018 and which are both herein incorporated by reference.

BACKGROUND OF THE INVENTION

Field of the Invention

The present invention relates to a method for producing a highly heat-resistant barrel provided with a twist profile, in particular for small-caliber automatic weapons.

Description of the Background Art

Barrels of small-caliber automatic weapons known in the art have a substantially shorter service life when there are intense firing cycles involving the use of hardcore ammunition which lead to a high degree of barrel heating (up to 500° C.). The high pressing forces which the hardcore projectile exerts on the inner wall of the barrel in each case and the drop in heat resistance due to the intense firing rhythm mean that the inner region of the corresponding barrel is plastically deformed. This results in the polygonal geometry or the field height of the respective twist profile being insufficient for reliable twist transmission to the projectile, meaning that the projectile yaws or moves sideways on the flight path due to a lack of speed and the required accuracy, range and effect of the projectile are lost.

One possible way of eliminating this disadvantage is disclosed in DE 10 2016 111 571 A1, which corresponds to WO 2017220348, which are incorporated herein by reference. This proposes that the height of the fields relative to the sides of the fields should be reduced by an amount that leads to the surface of the fields being formed by two areas which form an obtuse angle.

SUMMARY OF THE INVENTION

It is therefore an object of the present invention to specify a cost-effective method of producing a barrel in which substantial plasticization of the inner barrel wall, and therefore of the twisting profile, is avoided when hardcore ammunition is being fired, particularly with an intense firing rhythm.

The invention is substantially based on the basic idea of raising the hot-yield point from 640 MPa (conventional quenched and tempered steel with the designation 32CrMoV12-10), for example, to over 1000 MPa with an increase in temperature of the barrel to 500° C. and thereby achieving sufficient barrel strength, even at high temperatures. The consequence of this is that the material has a substantially higher yield point than 1000 MPa at room temperature.

However, materials with a high yield point (>1000 MPa) do not allow the use of a cost-effective method for the application of twist, such as hammering over a mandrel or extrusion.

Despite this, the invention envisages the use of cost-effective hammering or extrusion. This is possible when the production sequence is reversed. The profiling first takes place at a low strength level. The twist profile of the barrel is not introduced into a barrel blank, the material of which is already at its final strength due to quenching and tempering, but into one that has a lower strength level (approx. 800-1000 MPa). Only after the twist profile has been applied by extrusion or hammering does the quenching and tempering (or final quenching and tempering) of the steel to a predefined strength value >1000 MPa and the further mechanical processing of the barrel blank provided with the twist profile take place.

Because the twist profile can be influenced by the subsequent quenching and tempering process, changes in the barrel blank initially caused by quenching and tempering must be initially determined and then taken into account during the twist profiling (by means of a preliminary working dimension). As is generally known, the material undergoes volume changes during quenching and tempering which results in smaller caliber diameters after quenching and tempering. In the case of extrusion or hammering, the field/groove diameter selected must be less than 1/100 mm larger, in order to comply with the diameter tolerances. Where necessary, the field diameter can also be slightly mechanically reworked.

The quenching and tempering of the barrel blank which follows the twist profiling preferably takes place in a vacuum, in order to avoid scaling of the inner surface of the barrel. Insofar as required, the quenched and tempered barrel may be provided with an erosion protection layer in the form of hard chromium plating, for example.

Further details and advantages of the invention result from the following exemplary embodiment.

In this exemplary embodiment, in order to produce a barrel for an MG3 machine gun, heat-resistant steel with 0.25-0.35% C, 3-5% Cr, and 1-3% Mo is used. This steel is initially rough-machined into a barrel blank.

The inner barrel surface is then provided with the desired twist profile (in this case a field/groove profile) by extrusion, taking account of the previously determined rough-machining dimension.

The barrel blank provided with the twist profile is then quenched and tempered to the desired yield point of >1300 MPa by means of vacuum tempering. This initially involved heating the barrel blank to austenitization temperature with subsequent rapid cooling followed by tempering treatment to operational strength.

Following the quenching and tempering of the barrel blank, the mechanical finishing process finally takes place. An erosion protection layer, e.g. technical hard chromium plating, can be applied where necessary.

The invention is not of course limited to the exemplary embodiment described above. Hence, for example, another suitable high-alloy steel can be used. Moreover, the quenching and tempering of the barrel blank can take place in multiple sections, so that twist profiling takes place after a first quenching and tempering (preliminary quenching and tempering) with a yield point ≤1000 MPa and final tempering to a value >1000 MPa only takes place subsequently.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for producing a highly heat-resistant barrel provided with a twist profile for small-caliber automatic weapons, the method comprising:

introducing the desired twist profile into a barrel blank made of heat-resistant steel by extrusion or hammering, the heat-resistant steel has a yield point ≤1000 MPa at room temperature when the twist profile is introduced;

quenching the barrel blank after the twist profile is introduced;

tempering the barrel blank via vacuum tempering to a predefined strength value with a yield point >1000 MPa; and mechanically finishing the quenched and tempered barrel blank.

2. The method as claimed in claim 1, wherein a grade of steel with a yield point in the pre-tempered state ≥800 MPa is used to produce the barrel.

3. The method as claimed in claim 1, wherein a grade of steel from the CrMoV group is used for the barrel blank.

4. The method as claimed in claim 3, wherein an alloy with the main alloy elements of 0.25-0.35% C, 3-5% Cr, 1-3% Mo, and small fractions V, is used as the material for the barrel blank.

5. The method as claimed in claim 1, wherein the mechanically finished barrel is provided with erosion protection.

6. The method as claimed in claim 5, wherein the erosion protection comprises a hard chromium plating.

* * * * *